US008532538B2

(12) United States Patent
Inoue

(10) Patent No.: US 8,532,538 B2
(45) Date of Patent: Sep. 10, 2013

(54) IMAGE FORMING APPARATUS FEATURING SUPPLY OF DEVELOPERS HAVING DIFFERENT TONER RATIOS

(75) Inventor: Ryo Inoue, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 364 days.

(21) Appl. No.: 13/020,226

(22) Filed: Feb. 3, 2011

(65) Prior Publication Data

US 2011/0194875 A1 Aug. 11, 2011

(30) Foreign Application Priority Data

Feb. 9, 2010 (JP) ..... 2010-026864

(51) Int. Cl.
*G03G 15/08* (2006.01)

(52) U.S. Cl.
USPC ..... 399/255; 399/257; 399/259

(58) Field of Classification Search
USPC ..... 399/254, 255, 257–259
See application file for complete search history.

(56) References Cited

U.S. PATENT DOCUMENTS

| | | | | |
|---|---|---|---|---|
| 5,758,038 | A | 5/1998 | Itoh et al. | |
| 5,915,155 | A * | 6/1999 | Shoji et al. | 399/259 |
| 6,587,661 | B1 * | 7/2003 | Shimmura et al. | 399/257 |
| 6,947,688 | B2 | 9/2005 | Inoue et al. | |
| 7,729,642 | B2 * | 6/2010 | Matsumoto et al. | 399/258 |
| 7,925,188 | B2 * | 4/2011 | Senoh et al. | 399/255 |
| 8,369,752 | B2 * | 2/2013 | Furuta et al. | 399/259 |

FOREIGN PATENT DOCUMENTS

| | | |
|---|---|---|
| JP | 59-100471 B | 6/1984 |
| JP | 2-21591 B | 5/1990 |
| JP | 2007-93944 A | 4/2007 |

* cited by examiner

*Primary Examiner* — William J Royer
(74) *Attorney, Agent, or Firm* — Fitzpatrick, Cella, Harper & Scinto

(57) ABSTRACT

A developing device includes a developer carrying member; a first feeding path in which a developer is to be supplied and fed to the developer carrying member at a position in which the first feeding path opposes the developer carrying member; a second feeding path, communicating with the first feeding path, for forming a circulation path with the first feeding path; a discharge opening for permitting discharge of an excessive developer in the developing device; a first supply opening, located downstream of the first feeding path opposing the developer carrying member with respect to a developer feeding direction and located upstream of the discharge opening with respect to the developer feeding direction, for permitting supply of a first developer containing at least toner; and a second supply opening, located upstream of the first feeding path with respect to the developer feeding direction and located downstream of the discharge opening with respect to the developer feeding direction, for permitting supply of a second developer which has a toner ratio lower than that of the first developer or is consisting only of a carrier.

5 Claims, 9 Drawing Sheets

IMAGE FORMING APPARATUS FEATURING SUPPLY OF DEVELOPERS HAVING DIFFERENT TONER RATIOS

FIELD OF THE INVENTION AND RELATED ART

The present invention relates to an image forming apparatus in which a developer is to be supplied to a circulation path of the developer and on the ether hand, a developer which has been deteriorated is to be discharged from the circulation path through a discharge opening. More specifically, the present invention relates to disposition (arrangement) of the discharge opening and a supply position of the developer in a developing device.

The image forming apparatus in which an electrostatic image formed on a photosensitive member is to be developed with a two-component developer containing (non-magnetic) toner and a (magnetic) carrier has been widely used. In a developing device using the two-component developer, the toner and the carrier are triboelectrically charged by circulating the developer in the circulation path disposed along a developer carrying member while stirring the developer. Then, the charged developer slides on the photosensitive member in a state in which the toner is electrostatically carried on a magnetic chain of the carrier magnetically formed on the developer carrying member, so that only the toner is transferred onto the electrostatic image on the photosensitive member.

When the developing device using the two-component developer is continuously subjected to image formation, only the toner in the developer is consumed and decreased and therefore there is a need to supply fresh toner from a developer supply device so as to compensate for the toner consumption by the image formation. However, with respect to the two-component developer, the toner is replaced with fresh toner by the developer supply device and on the other hand, the carrier is continuously subjected to stirring and friction in the developing device, thus causing a problem such that a charging performance is gradually lowered. For this reason, in an image forming apparatus described in Japanese Patent Publication (JP-B) Hei 2-21591, the toner and a carrier are separately supplied to a circulation path of a developer and on the other hand, an excessive developer is discharged from a discharge opening provided in the circulation path, so that the carrier is also gradually replaced with fresh carrier.

In the case of the developing device described in JP-B Hei 2-21591, when a supply opening of the carrier is disposed on an upstream side of the discharge opening of the developer, the carrier which is only just supplied from the supply opening and is not deteriorated is to be discharged in a large amount. Further, when the discharge opening of the developer is disposed on the upstream side of a supply opening of the toner, a distance from the supply opening of the toner to a developer carrying member is decreased, so that the toner is not triboelectrically charged sufficiently. When the toner is not triboelectrically charged sufficiently, a problem of improper development or toner scattering is liable to occur. When the developer, which is mixed insufficiently and is in a non-uniform charged state, is subjected to development, the developer causes an image defect such as density non-uniformity or fog.

In the case of a developing device shown in FIGS. 17 and 18 of Japanese Laid-Open Patent Application (JP-A) 2007-93944, separately from a circulation path in which a developer is to be supplied to a developer carrying member, a dedicated feeding path in which a developer overflowed from the feeding path is to be mixed with a toner and a carrier and then is returned to a circulation path is provided. According to this constitution, the toner and the carrier are sufficiently stirred and mixed in the dedicated feeding path to triboelectrically charge the toner and therefore the problem as described above is obviated. However, a structure of the developing device is complicated and thus it is difficult to downsize the developing device and power consumption necessary for operation is increased.

SUMMARY OF THE INVENTION

A principal object of the present invention is to provide a developing device capable of ensuring sufficient mixing and stirring and of ensuring triboelectric charging until a developer reaches a developer carrying member, even when toner and a carrier are supplied to a circulation path of the developer, without adding a dedicated feeding path. As a result, another object of the present invention is to provide an image forming apparatus in which the carrier which is only just supplied and is not deteriorated is less liable to be discharged from a discharge opening, in which a charging performance of the developer is stable and reproducibility of an image density is high, and which is suitable for resource saving and electric power saving.

According to an aspect of the present invention, there is provided a developing device comprising:

a developer carrying member;

a first feeding path in which a developer is to be supplied and fed to the developer carrying member at a position in which the first feeding path opposes the developer carrying member;

a second feeding path, communicating with the first feeding path, for forming a circulation path with the first feeding path;

a discharge opening for permitting discharge of an excessive developer in the developing device;

a first supply opening, located downstream of the first feeding path opposing the developer carrying member with respect to a developer feeding direction and located upstream of the discharge opening with respect to the developer feeding direction, for permitting supply of a first developer containing at least toner; and a second supply opening, located upstream of the first feeding path with respect to the developer feeding direction and located downstream of the discharge opening with respect to the developer feeding direction, for permitting supply of a second developer which has a toner ratio lower than that of the first developer or is consisting only of a carrier.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, embodiments of the present invention will be described with reference to the drawings. The present invention can also be carried out in other embodiments in which a part or all of constitutions of the following embodiments are replaced with alternative constitutions so long as a carrier is supplied on a downstream side of a discharge opening with respected to a feeding direction.

Therefore, when an image forming apparatus effects image formation by using a two-component developer, the present invention can be carried out irrespective of a difference between a tandem type and a one-drum type and irrespective of a difference among an intermediary transfer type, a recording material conveying type and a direct transfer type. In the following embodiments, only a major part of the image forming apparatus relating to formation and transfer of the toner image will be described but the present invention can be carried out in various fields of apparatuses or machines such as printers various printing machines, copying machines, facsimile machines, and multi-function machines.

Incidentally, general matters of the image forming apparatuses described in JP-B Hei 2-21591 and JP-A 2007-93944 will be omitted from illustration and redundant explanation.

<Image Forming Apparatus>

Figure 1:
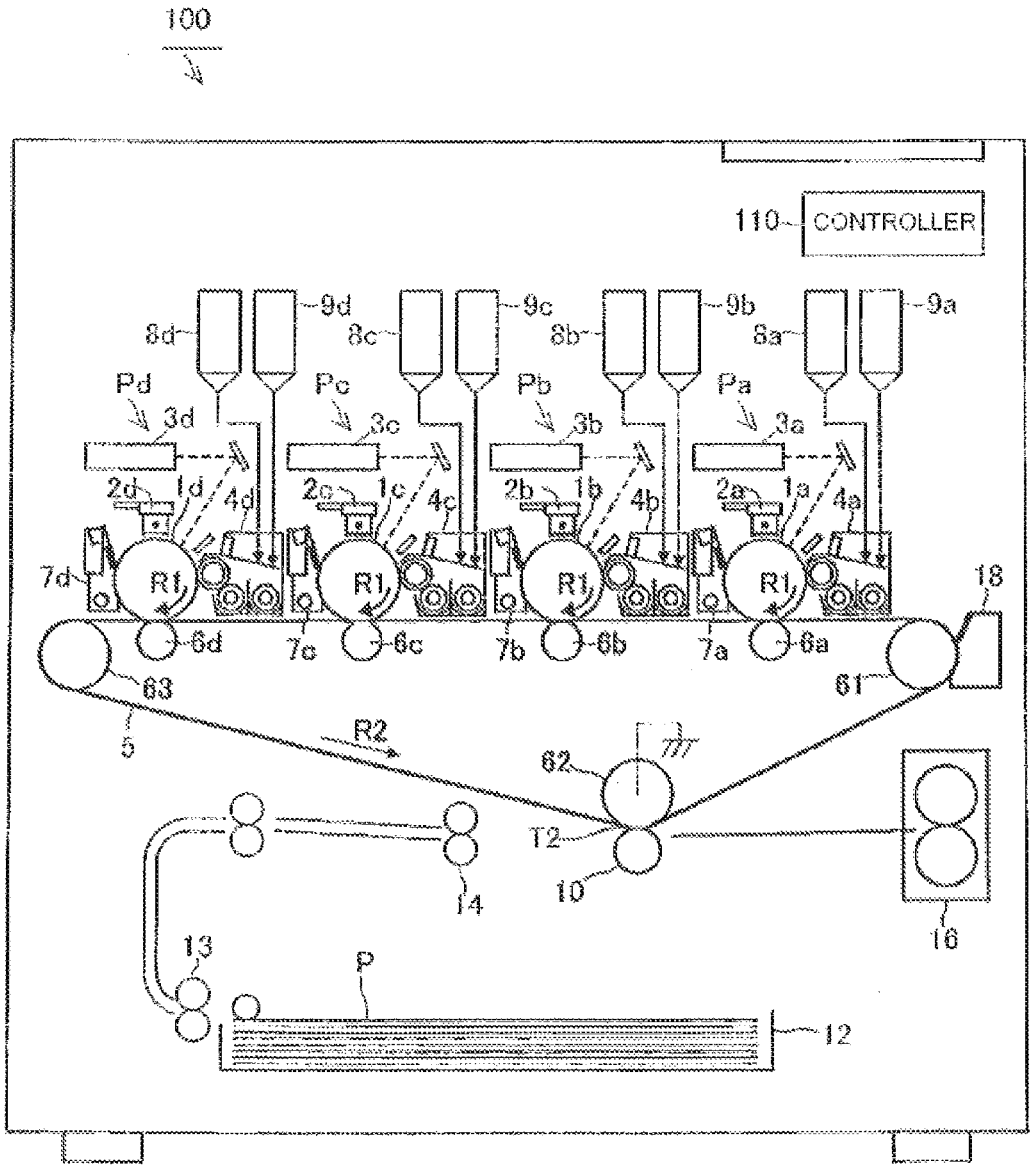
FIG. 1 is an illustration of a structure of an image forming apparatus.

FIG. 1 is an illustration of a structure of an image forming apparatus 100. As shown in FIG. 1, the image forming apparatus 100 is an intermediary transfer type full-color printer of the tandem type in which image forming portions Pa for yellow, Pb for magenta, Pc for cyan, and Pd for black are disposed along an intermediary transfer belt 5.

At the image forming portion Pa, a yellow toner image is formed on a photosensitive drum 1*a* and then is primary-transferred onto the intermediary transfer belt 5. At the image forming portion Pb, a magenta toner image is formed on a photosensitive drum 1*b* and then is primary-transferred superposedly onto the yellow toner image on the intermediary transfer belt 5. At the image forming portions Pc and Pd, a cyan toner image and a black toner image are formed on a photosensitive drum 1*c* and a photosensitive drum 1*d*, respectively, and are similarly primary-transferred superposedly onto the intermediary transfer belt 5.

The four color toner images carried on the intermediary transfer belt 5 are conveyed to a secondary transfer portion T2, a which the four color toner images are collectively secondary-transferred onto a recording material P. The recording material P on which the four color-based full-color images are secondary-transferred is curvature-separated from the intermediary transfer belt 5 and is sent into a fixing device 16. The fixing device 16 heats and presses the recording material P, so that the toner images are fixed on a surface of the recording malarial P. Thereafter, the recording material P is discharged outside the image forming apparatus 100.

The image forming portions Pa, Pb, Pc and Pd have the substantially same constitution except that the colors of toners of yellow for a developing device 4*a* provided at the image forming portion Pa, of magenta for a developing device 4*b* provided at the image forming portion Pb, of cyan for a developing device 4*c* provided at the image forming portion Pc, and of black for a developing device 4*d* provided at the image forming portion Pd are different from each other. In the following description, the image forming portion Pd for black will be described and with respect to other image forming portions Pa, Pb and Pc, the suffix d of reference numerals (symbols) for representing constituent members (means) for the image forming portion Pd is to be read as a, b and c, respectively, for explanation of associated ones of the constituent members for the image forming portions Pa, Pb and Pc.

At the image forming portion Pd, around the photosensitive drum 1*d*, a corona charger 2*d*, an exposure device 3*d*, the developing device 4*d*, a primary transfer roller 6*d* and a drum cleaning device 7*d* are disposed. The photosensitive drum 1*d* is constituted by forming a negatively chargeable photosensitive layer on a substrate of an aluminum cylinder and is rotated at a process speed of 273 mm/sec in a direction indicated by an arrow R1.

The surface of the photosensitive drum 1*d* is irradiated with charged particles accompanying corona discharge by the corona charger 2*d*, so that the surface of the photosensitive drum 1*d* is electrically charged uniformly to a negative-polarity dark portion potential VD. The exposure device 3*d* writes (forms) a latent image for an image on the charged surface of the photosensitive drum 1*d* by scanning of the charged surface through a rotation mirror with a laser beam obtained by ON-OFF modulation of scanning line image data expanded from a separated color image for black. The surface potential of the photosensitive drum 1*d* charged to a dark portion potential is lowered to a light portion potential VL by being subjected to the exposure, so that the negatively charged toner can be deposited on the photosensitive drum 1*d*. Incidentally, the exposure device 3*d* can also employ another pixel-array light-emitting member such as a light-emitting diode element array, in place of the laser beam scanner.

The developing device 4*d* reversely develops the electrostatic image formed on the photosensitive drum 1*d* to form the toner image as described later.

The primary transfer roller 6*d* urges the inner surface of the intermediary transfer belt 5 to form a primary transfer portion between the photosensitive drum 1*d* and the intermediary transfer belt 5. By applying a positive-polarity voltage to the primary transfer roller 6*d*, the toner image carried on the photosensitive drum 1*d* is primary-transferred onto the intermediary transfer belt 5.

The drum cleaning device 7*d* rubs the photosensitive drum 1*d* with a cleaning blade to collect transfer residual toner remaining on the photosensitive drum 1*d* without being primary-transferred onto the intermediary transfer belt 5.

The intermediary transfer belt 5 is supported by being extended around a tension roller 61, a driving roller 63 and an opposite roller 62 and is driven by the driving roller 63, thus being rotated at the process speed of 273 mm/sec in the direction indicated by an arrow R2.

A secondary transfer roller 10 is contacted to the intermediary transfer belt 5 which is supported by the opposite roller 62 at an inner surface, thus forming the secondary transfer portion T2. The recording material P pulled out from a recording material cassette 12 is separated one by one by a separation roller 13 to be sent to registration rollers 14. The registration rollers 14 receive the recording material P in a rest state to place the recording material P in a stand-by condition and then sends the recording material P to the secondary transfer portion T2 while timing the recording material P to the toner images on the intermediary transfer belt 5.

In a process in which the recording material P is nip-conveyed at the secondary transfer portion T2 while being superposed with the toner images, the positive-polarity DC voltage is applied to the secondary transfer roller 10, so that the full-color toner images are secondary-transferred from the intermediary transfer belt 5 onto the recording material P. Transfer residual toner remaining on the surface of the intermediary transfer belt 5 without being transferred is collected by a belt cleaning means 18.

Incidentally, as the photosensitive drum 1*d*, an inorganic photosensitive member such as an amorphous silicon photosensitive member may also be used. Further, a belt-like photosensitive member can also be used. Also with respect to the charging type, the transfer type, the cleaning type and the fixing type, the types are not limited to those described above.

<Developing Device>

Figure 2:
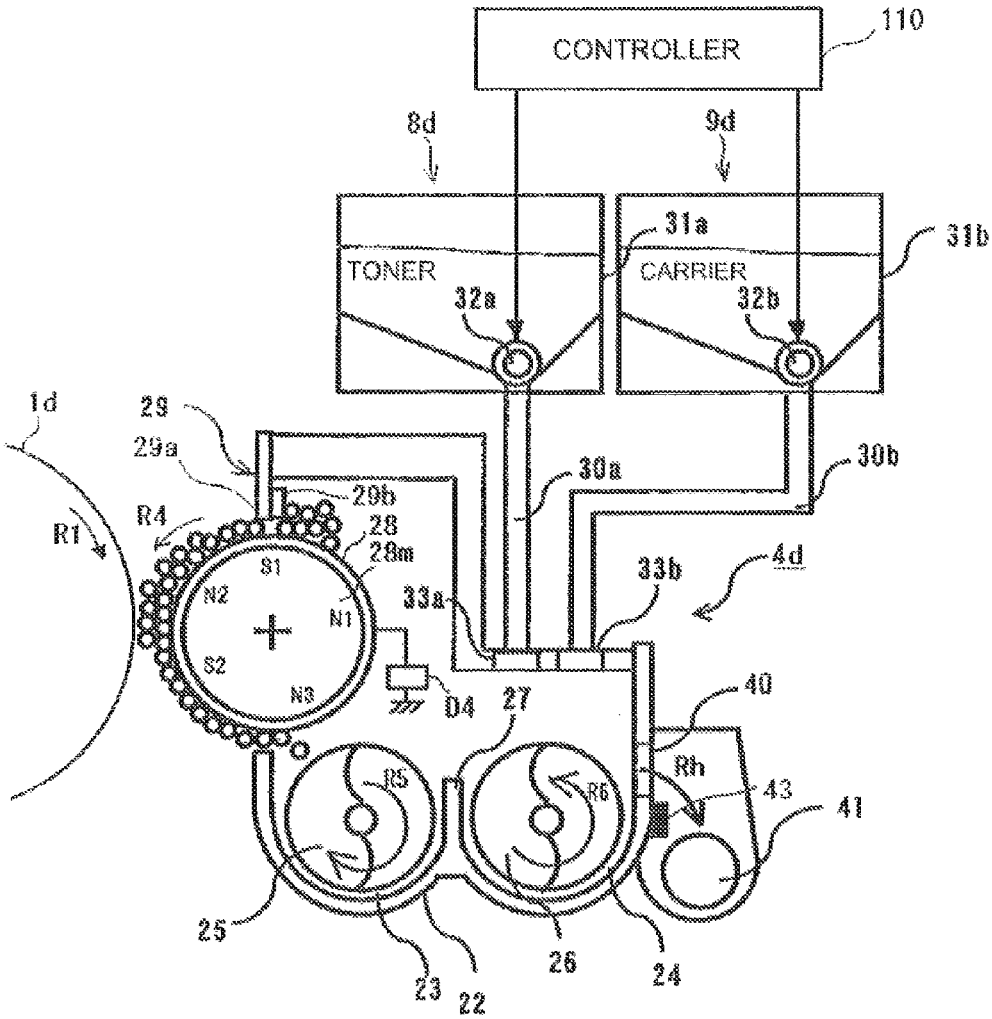
FIG. 2 is an illustration of a structure of a developing device.
Figure 3:
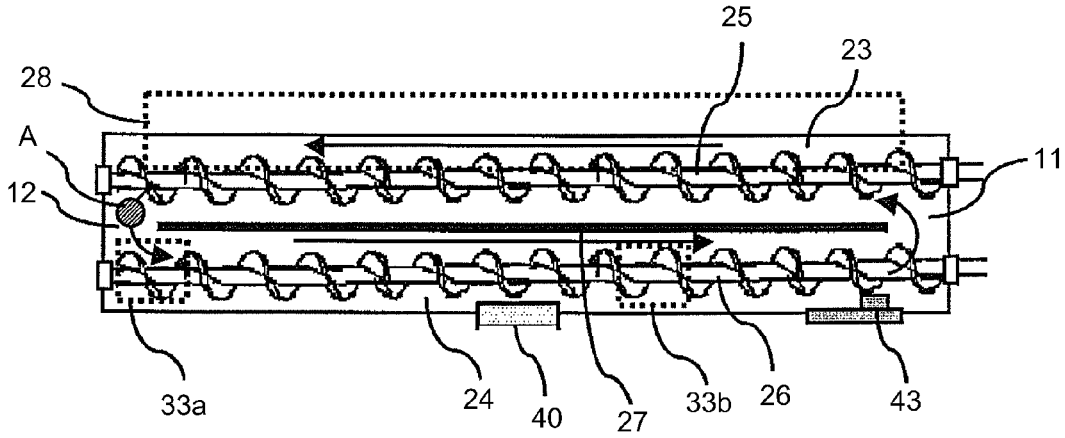
FIG. 3 is a plan view of the developing device.

FIG. 2 is an illustration of a structure of a developing device. FIG. 3 is a plan view of the developing device.

As shown in FIG. 2, with respect to the developing device 4*d*, a developing sleeve 28 is disposed so as to oppose the photosensitive drum 1*d* with a predetermined gap from the surface of the photosensitive drum 1*d*. The developing device 4*d* charges a developer (two-component developer) containing a toner and a carrier and carries the developer on the rotating developing sleeve 28, thus feeding the developer to an opposing portion where the developing sleeve 28 opposes the photosensitive drum 1*d*. The developer deposits the toner on the electrostatic image by sliding on the electrostatic image on the photosensitive drum 1*d* in a magnetic brush state, so that the reverse development is effected.

As shown in FIG. 3, in a process in which the developer is circulated in a direction indicated by arrows in a developing container 22 while being stirred, the toner and the carrier rub each other, so that the toner is negatively charged and the carrier is positively charged. An inner portion of the developing container 22 is partitioned into a developing chamber 23 and a stirring chamber 24 at a substantially longitudinal central portion by a partition wall 27 extending in a longitudinal direction. The developing chamber 23 and the stirring chamber 24 communicate with each other at openings 11 and 12 at longitudinal end portions of the partition wall 27.

In the developing chamber 23 which is an example of a first feeding path, a feeding screw 25 which is an example of a first feeding member is disposed. In the stirring chamber 24 which is an example of a second feeding path, a feeding screw 26 which is an example of a second feeding member is disposed. The feeding screw 25 is disposed along and in substantially parallel to the developing sleeve 28 and as shown in FIG. 2, feeds the developer to the developing sleeve 28 by its rotation. The feeding screw 25 is rotated in the direction (clockwise direction) indicated by an arrow R5. This is because the rotation in the clockwise direction is advantageous from the viewpoint of the feeding of the developer to the developing sleeve 28.

The feeding screw 26 is disposed in the stirring chamber 24 in substantially parallel to the feeding screw 25 and is rotated in the direction (counterclockwise direction) indicated by arrow R6 opposite to the rotational direction of the feeding screw 25. The feeding screws 25 and 26 feed the developer in opposite directions with respect to the longitudinal direction while interposing the partition wall 27 therebetween, so that the developer is transferred through the openings 11 and 12 of the partition wall 27 shown in FIG. 3, thus being circulated between the developing chamber 23 and the stirring chamber 24.

As shown in FIG. 2, an opening of the developing container 22 is provided at a position corresponding to a developing region in which the developing sleeve 28 opposes the photosensitive drum 1*d*, and the developing sleeve 28 is disposed rotatably at the opening so as to be partly exposed toward the photosensitive drum 1*d*. The developing sleeve 28 is constituted by a non-magnetic material such as aluminum or stainless steel and has a diameter of 20 mm. The photosensitive drum 1*d* has a diameter of 80 mm. In the developing region in which the developing sleeve 28 and the photosensitive drum 1*d* are closest to each other, an opposing distance between the developing sleeve 28 and the photosensitive drum 1*d* is set at about 400 μm so that the development can be effected in a state in which the developer fed in the developing region is contacted to the photosensitive drum 1*d*.

Inside the developing sleeve 28, a magnet roller 28*m* which is a magnetic field-generating member for confining the carrier is disposed in a non-rotatable state. The magnet roller 28*m* has a developing pole (magnetic pole) S2 disposed to oppose the photosensitive drum 1*d*, a magnetic pole S1 disposed to oppose a regulating blade (chain-cutting member) 29, a magnetic pole N2 disposed between the magnetic poles S1 and S2, and magnetic poles N1 and N3 disposed to oppose the developing chamber 23.

The developing sleeve 28 is, during the development, rotated in the direction (counterclockwise direction) indicated by an arrow R4 and feeds the developer, which has been subjected to layer thickness regulation by the magnetic brush chain cutting with the regulating blade 29, into the developing region in which the developing sleeve 28 opposes the photosensitive drum 1*d* while carrying the developer thereon. In the developing region, the magnetic brush of the two-component developer formed in response to the magnetic field of the developing pole S2 deposits the toner on the photosensitive drum 1*d* while sliding on the electrostatic image formed on the photosensitive drum 1*d*, so that the electrostatic image is reversely developed.

At this time, in order to improve a developing efficiency, i.e., a toner depositing ratio onto the electrostatic image, to the developing sleeve 28, an oscillating voltage in the form of the DC voltage Vdc biased with an AC voltage is applied from a power source D4. In this embodiment, a rectangular AC voltage of 1800 V in peak-to-peak voltage Vpp and 12 kHz in frequency was superposed on the DC voltage Vdc of −500 V. However, values of the DC voltage Vdc and the AC voltage Vpp and the waveform are not limited to those described above.

In such a magnetic brush developing method, when the AC voltage is applied, the developing efficiency is increased and thus the image is high in its quality. However, on the other hand, a white background fog image formed by depositing the toner on a white background of the image is liable to occur. For this reason, the white background fog is prevented by providing a potential difference (fog-removing contrast) between the DC voltage Vdc applied to the developing sleeve 28 and the charged potential (white background portion potential) of the photosensitive drum 1*d*.

The regulating blade 29 which is the magnetic brush chain-cutting member is disposed on the upstream side of the photosensitive drum 1*d* with respect to the rotational direction of the developing sleeve 28 and extends along the longitudinal direction of the developing sleeve 28. The regulating blade 29 is constituted by a non-magnetic member 29*a* which is formed with a plate-like aluminum material and is configured to regulate the layer thickness and by a magnetic member 29*b* such as an iron member for forming a developer stagnation portion by magnetically constraining the carrier loosely.

Then, in the gap between a free end of the regulating blade 29 and the developing sleeve 28, the developer passes and is fed to the developing region. By adjusting this gap, a cut amount of the chain of a magnetic brush of the developer formed on the developing sleeve 28 is regulated, so that the amount of the developer fed to the developing region is adjusted. The gap between the regulating blade 29 and the developing sleeve 28 may be set at 200-1000 μm, preferably 300-700 μm. In this embodiment, the gap is set at 500 μm, so that a coating amount per unit area of the developer on the developing sleeve 28 is regulated at 30 mg/cm$^2$ by the regulating blade 29.

In the developing region, the developing sleeve 28 rotates in the same direction as the surface movement direction of the photosensitive drum 1*d*, and at a peripheral speed ratio thereof to the photosensitive drum 1*d* is 1.75. The peripheral speed ratio may be set at any value so long as it is set in the range of 0-3.0, preferably in the range of 0.5-2.0. The developing efficiency is increased with a higher movement speed ratio but an excessively high speed ratio liable to cause problems of toner scattering, deterioration of the developer and therefore it is preferable that the speed ratio is set in the range described above.

<Two Component Developer>

The developer (two component developer) contains the (non-magnetic) toner and the agnetic) carrier as the main components. The toner contains a binder resin, a colorant, and, as needed colored particles containing another additive-containing colored resin particles and an external additive such as colloidal silica fine powder externally added to the colored resin particles. The toner is a negatively chargeable polyester-based resin and may preferably have a volume-average particle size of 4 μm or more and 10 μm or less, and preferably be 8 μm or less.

Further, as the carrier, it is possible to use, e.g., surface-oxidized or un-oxidized metals such as iron, nickel, cobalt, manganese, chromium, rare-earth elements; alloys of these metals; and oxide ferrite. A manufacturing method of these magnetic particles is not particularly limited. The carrier may have a weight-average particle size of 20-60 μm; preferably 30-50 μm and may have a resistivity of $10^7$ Ωcm or more, preferably $10^8$ Ωcm or more. In this embodiment, the carrier having the resistivity of $10^8$ Ωcm or more was used.

The volume-average particle size of the toner was measured by using a measuring device and a measuring method described below. As the measuring device, a Coulter counter A-II (mfd. by Coulter Co. Ltd.) was used. As an electrolytic solution, a 1%-aqueous NaCl solution prepared by using reagent-grade sodium chloride was used.

The measuring method is as follows. That is, to 100-150 ml of the electrolytic solution, 0.1 ml of a surfactant as a dispersant, preferably, alkylbenzenesulfonic acid salt, was added, and to this mixture, 0.5-50 mg of a measurement sample was added. Then, the electrolytic solution in which the measurement sample was suspended was subjected to dispersion in an ultrasonic dispersing device for about 1-3 minutes. Then, the particle size distribution of the toner particles, the size of which is in the range of 2-40 μm was measured with the use of the above-mentioned Coulter Counter TA-II fitted with a 100 μm aperture, and volume-average distribution was obtained. Then, a volume-average particle size was obtained from the thus-obtained volume-average distribution.

The resistivity of the magnetic carrier was measured by using a cell of the sandwich type with a measurement electrode area of 4 cm$^2$ and an electrode gap of 0.4 cm. A voltage E (V/cm) was applied between two electrodes of the cell under application of 10N (1 kg) of load on one electrode of the cell, to measure the resistivity of the carrier obtained from the amount of the current which passed through the circuit.

<Developer Supply Device>

In the color image forming apparatus for forming a full-color image or a multi-color image by an electrophotographic process, from the viewpoints of coloring property and color-mixing property, the two-component developer containing the toner and the magnetic carrier in mixture is used. Then, in the two-component developing method, in order to maintain a stable quality image for a long term, it is important to impart a stable toner charge amount Q/M (triboelectric charge) to the toner. For that purpose, there is a need to stably maintain a charge-imparting ability (performance) of the carrier to the toner even when the image formation is cumulatively effected.

However, actually, the toner is gradually consumed by the image formation and is replaced with fresh toner, which has been supplied, as occasion arises. On the other hand, the carrier is not consumed but is continuously stirred while stagnating in the developing device. For this reason, when the developing device is used for a long time, the carrier and the toner are in prolonged contact with each other such that there is a possibility that the carrier surface is contaminated by deposition of the toner or the external additive to the toner is increased. As a result, the charge-imparting performance of the carrier to the toner is lowered and thus the toner charge amount Q/M is towered, so that the lowering in image quality such as the toner scattering or the fog image is liable to occur.

One of the methods for solving the problems of the carrier deterioration described above is a method in which a service person replaces a deteriorated developer, which has reached its durable lifetime, with a fresh one during periodical maintenance service. However, when this method is employed, the lifetime of the developer determines a maintenance service interval and therefore there is a need to perform the maintenance service frequently, so that a running cost of the image forming apparatus is increased. The maintenance service interval may preferably be set at a large value from the viewpoints of a burden on the service person, cost and downtime of the image forming apparatus.

Another method for solving the carrier deterioration problems is to develop a developer which is not lowered in charge imparting performance even under friction for a long time and to develop a method for operating the developing device without deteriorating the developer. However, even when these methods are employed, a current lifetime of the developer remains at a level from about 30,000 sheets to about 50,000 sheets in continuous image formation.

Therefore, a method in which an excessive developer is taken out from the developing device by supplying to the developing device a supply developer in which the carrier is mixed with the toner in advance (e.g., at a mixing weight ratio of 10%) has been put into practical use. In this embodiment, by providing a supply device of the fresh developer to the developing device, so-called trickle supply is effected and thus the lowering in charge imparting performance is suppressed. The excessive developer caused by the supply of the fresh developer is collected by overflow thereof from a discharge opening provided in a wall surface of the developing container.

In the trickle supply-overflow method, the supply of the fresh carrier and the discharge of an old developer are successively repeated by the supply of the developer, so that the carrier in the developing device is replaced with the supplied fresh carrier as occasion arises. For this reason, the lowering in charge imparting performance of the developer in the developing device is suppressed and a developing property of the developer is kept at a constant level, so that the lowering in copy image quality is suppressed. As a result, the maintenance service interval for performing the exchange of the developer is extended or there is no need to exchange the developer itself.

However, in the trickle supply-overflow method, the mixture of the toner and the carrier preliminarily mixed at a constant ratio is used as the supply developer and therefore there arises a problem that the supply in conformity with a deterioration state of the carrier.

For example, in the case where the image formation with a small consumption amount of the toner per sheet (at a low image ratio) is continued, the amount of the supplied developer is small and thus the carrier is not renewed. On the other hand, the developer is continuously stirred and therefore an overage charge imparting performance of the carrier is lowered. As a result of the operation of the developing device with substantially no carrier supply, spent carrier is mixed with the toner and thus there is a possibility that the toner charge amount Q/M is lowered.

On the other hand, in the case where the image formation with a large consumption amount of the toner per sheet (at a high image ratio) is continued, the amount of the supplied developer is large and thus the carrier is supplied more than necessary, so that the carrier which has not been deteriorated in charging performance is unnecessarily discharged. This leads too useless disposal of the carrier to increase the running cost.

Further, in the trickle supply-overflow method, compared with the developer (5 to 12 wt. %) in the developing device, the supply developer is extremely high in toner ratio (90 wt. %). This ratio is set so that the carrier is properly replaced depending on the lifetime of the carrier in the developing device 4*d* in the continuous image formation with an average image ratio.

In such a developer having the extremely large toner amount, there are many toner particles which have a specific gravity lower than that of the carrier and which cannot be caught by the carrier, so that the toner and the carrier are not mixed uniformly in some cases in the container storing the supply developer.

When the mixed state of the toner and the carrier is non-uniform, the supply of the carrier becomes further inaccurate, so that there arises a problem that the carrier deterioration and the unnecessary carrier consumption are further accelerated. In order to uniformly mix the toner and the carrier in the supply container of the supply developer, the supply container is required to be elongated or provided with a stirring member, so that a layout of the developing device is limited and the supply container is increased in cost.

Here, in the case where 100%-toner and 100%-carrier are independently supplied as described in JP-B Hei 2-21591, it is possible to effect the supply of the carrier in conformity with the deterioration state of the carrier in the developer without being affected by the toner consumption amount. For example, irrespective of the image ratio, it is possible to effect control for supplying the carrier depending on an operation time of the developing device. Further, when a degree of the deterioration of the carrier in the developer is sensitive to a temperature of the developing device, the supply amount of the carrier can be controlled by taking the factor into consideration.

However, in the case where a second supply device for supplying the carrier is provided, depending on its disposition, the supplied carrier can be discharged through the discharge opening In order to realize lifetime extension by the supply of the carrier, the overflow of only the deteriorated carrier front the discharge opening by the supply of the fresh carrier is ideal.

On the other hand, in the first supply device for supplying the toner, depending on its disposition, the supplied toner can reach the developing sleeve to be carried before the supplied toner is mixed with the developer and is triboelectrically charged sufficiently. When the development is effected with the toner in non-uniform charged state due to insufficient mixing, image defect such as density non-uniformity or fog is caused. This is conspicuous with a larger amount of toner consumption, i.e., with a large amount of toner supply.

Further, also with respect to the discharge opening, depending on the disposition of the discharge opening, a developer surface is not stabilized by the toner consumption and thus the discharge of the developer is not effected with good responsiveness, with the result that improvement in charging performance of the developer is delayed in some cases. This phenomenon is also conspicuous with the larger amount of toner consumption.

In recent years, the image forming apparatus is strongly required to have a performance for compatibly realizing speed-up of image output and stabilization of image quality, so that the developing device operated stably with respect to an abrupt change in consumption amount of the toner. Further, downsizing of the developing device is also required correspondingly to downsizing of the image forming apparatus, so that realization of the speed-up and the stabilization under the constraint of space is regarded as important.

In the following embodiments, in the developing device in which the toner and the carrier are independently supplied and then the developer is overflowed from the discharge opening, a positional relationship between a toner supply position and a carrier supply position is improved. The order when a downstream side end portion of the developer carrying member with respect to a circulation direction of the developer is taken as a starting point is the toner supply position, the discharge opening and the can supply position along the developer circulation direction. As a result, a degree Of recovery of the charging performance of the developer by the supply of the carrier is made efficient and quick and at the same time, non-uniformity of a distribution of the toner and the carrier in the developer by the supply of the toner is suppressed.

Embodiment 1

Figure 4:
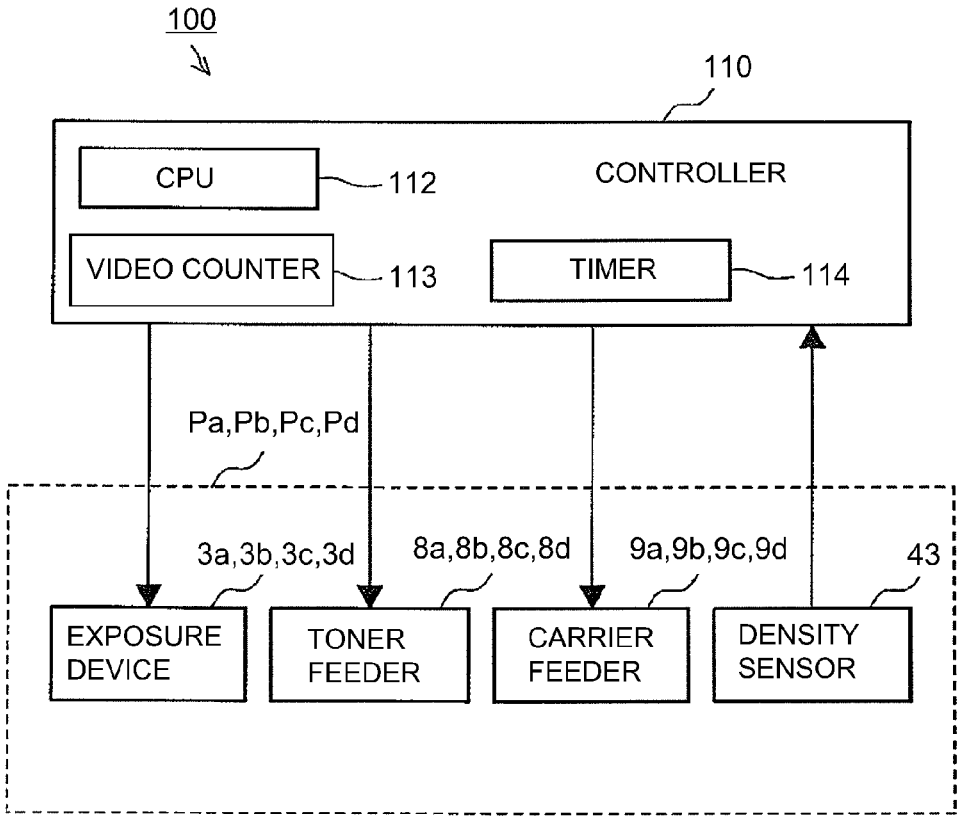
FIG. 4 is a block diagram of a control system of the developing device.
Figure 5:
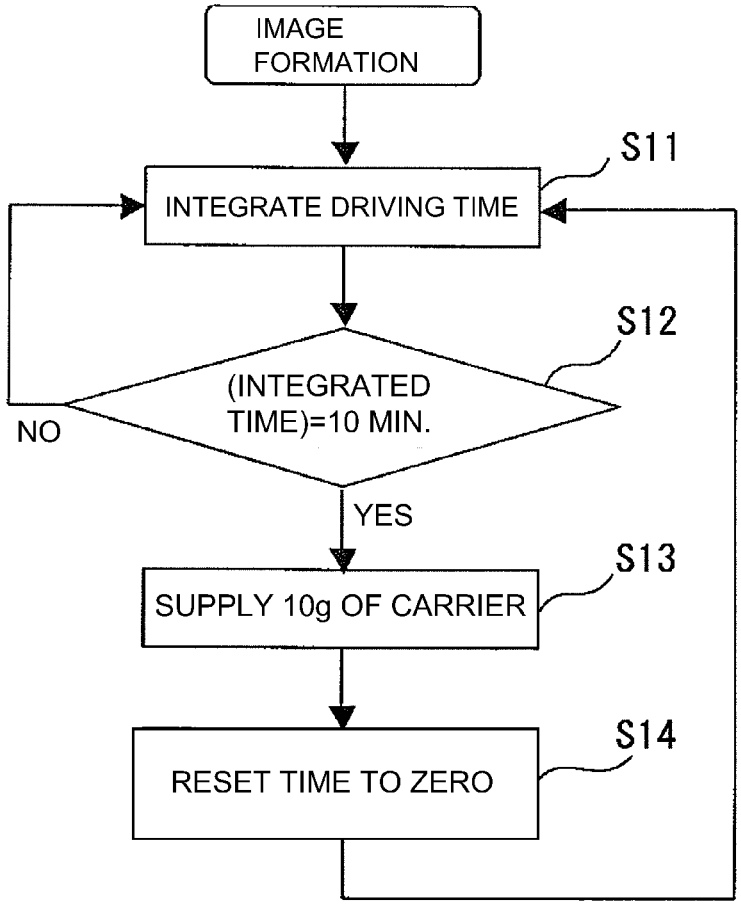
FIG. 5 is a flowchart of carrier supply control.

FIG. 4 is if block diagram of a control system of the developing device. FIG. 5 is a flowchart of carrier supply control. Figure is a graph for illustrating an effect of the carrier supply control.

As shown in FIG. 2, at an upper portion of the developing device 4*d*, a toner supply portion 8*d* which is an example of a first developer supply device and a carrier supply portion 9*d* which is an example of a second developer supply device are connected.

The toner supply portion 8*d* supplies a first developer, having the toner ratio higher than that of the developer which circulates in the developing device 4*d*, to an upstream side end portion of the stirring chamber 24. In this embodiment, in a hopper 31*a* of the toner supply portion 8*d*, the supply developer containing the toner, in the weight ratio of 100%, identical to that in the developer filled in the developing device 4*d* is accommodated.

The toner supply portion 8*d* supplies the first developer to a position on the upstream side of a discharge opening 40 in the circulation path of the developer with respect to a developer feeding direction and on the downstream side of an opposing region, in which the toner supply portion 8*d* opposes the developing sleeve 28 in a first feeding path, with respect to the developer feeding direction. However, the first developer is not limited to the 100%-toner but may also be one in which the carrier is mixed in a small amount with the toner in order to enhance a mixing property with the developer which circulates in the stirring chamber 24.

The carrier supply portion 9*d* supplies a second developer, having the carrier ratio higher than that of the developer which circulates in the developing device 4*d*, to an intermediary position of a second feeding path in the stirring chamber 24 with respect to the developer feeding direction. In this embodiment, in a hopper 31*b* of the carrier supply portion 9*d*, the supply developer containing the carrier, in the weight ratio of 100%, identical to that in the developer filled in the developing device 4*d* is accommodated.

The carrier supply portion 9*d* supplies the second developer to a position on the downstream side of the discharge opening 40 with respect to a developer feeding direction and on the upstream side of an opposing region, in which the carrier supply portion 9*d* opposes the developing sleeve 28 in a first feeding path, with respect to the developer feeding direction. However, the second developer is not limited to the 100%-toner carrier since the second developer can be smaller in toner ratio than that of the first developer or can be consisting only of the carrier, but may also be one in which the toner is mixed in a small amount with the carrier in order to enhance a mixing property with the developer which circulates in the stirring chamber 24.

The toner supply portion 8*d* includes a screw-like feeding member 32*a* at a lower portion of the hopper 31*a*. One end of the feeding member 32*a* is connected to a toner supply opening 33*a* of the developing device 4*d*. The toner in an amount corresponding to that of the toner consumed by the image formation is supplied from the hopper 31*a* to the developing container 22 through the toner supply opening 33*a* via a toner supply path 30*a* by a rotational force of the feeding member 32*a* and gravitation exerted on the toner. In this way, the toner is supplied from the hopper 31*a* to the developing device 4*d*.

The toner supply amount is roughly determined by the rotation number (number of revolutions) of the feeding member 32*a* but the rotation number is determined by toner supply amount control executed by a control portion (CONTROLLER) 110.

As shown in FIG. 4 with reference to FIG. 2, the control portion 110 controls the toner supply portions (TONER FEEDER) 8*a*, 8*b*, 8*c* and 8*d* and the carrier supply portions (CARRIER FEEDER) 9*a*, 9*b*, 9*c* and 9*d* of the four image forming portions Pa, Pb, Pc and Pd (FIG. 1).

In this embodiment, the toner supply amount is obtained from a video count output, and a toner content detection sensor (DENSITY SENSOR) 43 is used for modifying the toner supply amount so that the toner content is not out of a proper range.

The control portion 110 obtains the toner consumption amount per sheet, subjected to the image formation, on the basis of the video count output from a video counter 113 and supplies the toner to the developing container 22 by rotating the feeding member 32*a* by an amount corresponding to the toner consumption amount in the image formation on the immediately preceding sheet. The video count output is obtained by quantifying an image signal for actuating the exposure device 3*a*, 3*b*, 3*c* and 3*d* and is integrated correspondingly to the image on one sheet by a CPU 112, so that the amount of the toner taken out of the developing device 4*d* by the development for a current image.

The control portion 110 detects the output of the toner content detection sensor 43 provided to the developing device 4*d* to obtain the toner content (weight ratio) in the developer fed in the stirring chamber 24. The toner content detection sensor 43 is of the type in which the toner content is estimated by measuring inductance of the developer. The control portion 110 increases, when the toner content is below a tolerable range, the toner supply amount obtained by the video count method, so that the toner content is increased. On the other hand, when the toner content is above the tolerable range, the control portion 110 decreases the toner supply amount, so that the toner content is decreased.

Next, a carrier supplying method will be described. The carrier supply portion 9*d* includes a screw-like feeding member 32*b* at a lower portion of the hopper 31*b*. One end of the feeding member 32*b* is connected to a carrier supply opening 33*b* of the developing device 4*d*. The carrier is an amount corresponding to the overflow amount from the discharge opening 40 is supplied from the hopper 31*b* to the developing container 22 through the carrier supply opening 33*b* via a carrier supply path 30*b* by a rational force of the feeding member 32*b* and gravitation exerted on the carrier. In this way, the carrier is supplied from the hopper 31*b* to the developing device 4*d*.

The control portion 110 executes carrier supply control for supplying the carrier depending on the operation time of the developing device 4*d* by using a timer 114. The timer 114 integrates an accumulated time of the rotation time of the developing device 4*d*.

As shown in FIG. 5 with reference to FIG. 2, in this embodiment, 10 g of the carrier is supplied every integration of 10 minutes of the operation time of the developing device 4*d*. The control portion 110 integrates the operation (drive) time of the developing device 4*d* (S11) and supplies 10 g of the carrier (S13) every lapse of 10 minutes which is the integrated time (YES of S12). After the supply, the integrated time is reset to zero (S14) and then the integration for subsequent carrier supply is started (S11 and NO of S12).

As shown in FIG. 3, the carrier is supplied to the stirring chamber 24 from the carrier supply opening 33*b* disposed on the downstream side of the discharge opening 40 through which the excessive developer in the circulation path is to be discharged, thus being stirred and mixed with the already-existing developer. Then, the carrier is conveyed in the developing chamber 23 along the developing sleeve 28 while being stirred and then is transferred to the stirring chamber 24, thus moving the circulation path by almost one full circulation distance. Then, the supplied carrier is overflowed from the discharge opening 40 in a state in which the carrier is mixed substantially uniformly.

In order to check the effect of the carrier supply, in the control of Embodiment 1 in which the carrier supply was effected in addition to the toner supply and in Comparative Embodiment 1 in which only the toner supply was effected but the carrier supply was not effected, the progression of the toner charge amount Q/M was measured and compared.

Figure 6:
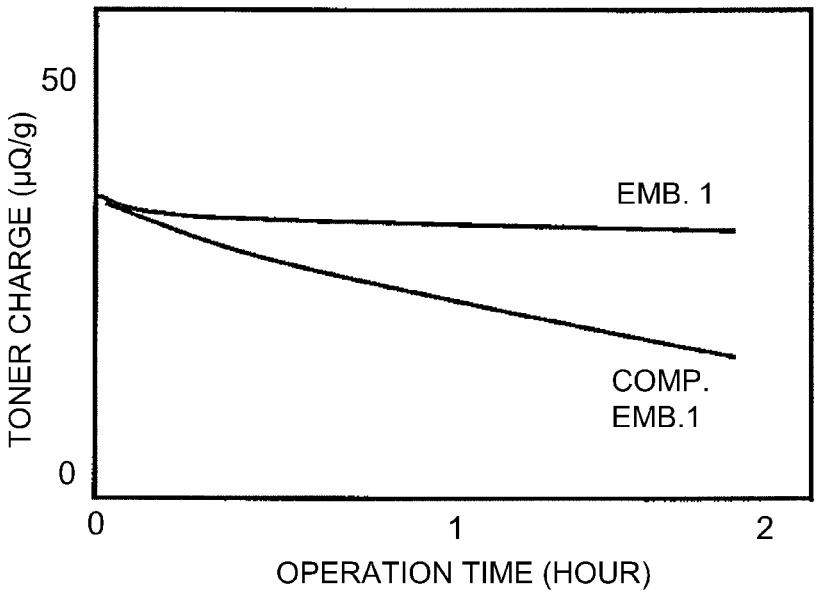
FIG. 6 is a graph for illustrating an effect of the carrier supply control.

As shown in FIG. 6, in Embodiment 1, a toner deterioration state is stably kept at a constant value sine the overflow from the discharge opening 40 is effected in a state in which 10 g of the carrier is supplied every 10 minutes and is uniformly dispersed. On the other hand, in Comparative Embodiment 1 in which the carrier supply is not effected, with accumulation of the operation time of the developing device, the deterioration of the carrier progresses, so that the toner charge amount Q/M is continuously lowered.

It would be considered that the lowering in toner charge amount Q/M is a phenomenon as described below. As a factor by which the charging performance of the carrier with respect to the toner, there are various factors. However, of these factors, the biggest factor is so-called "toner spent (spent toner)" such that the resin material constituting the toner is melt-fixed on the carrier. When the toner spent occurs, the portion is covered with the resin material and thus cannot triboelectrically charge the toner, so that the charging performance is lowered. It is considered that a main factor of the toner spent is such a phenomenon that the resin material of the toner is removed by strong contact between the toner and the carrier under application of pressure to the developer and then is developed on the carrier.

In the developing device 4*d*, the pressure is exerted most on the developer in the neighborhood of an upstream portion of the regulating blade 29 which is a layer thickness regulating portion of the developer to be carried on the developing sleeve 28. It would be considered that the toner spent in the developer progresses in a degree corresponding to the number of passages of the developer through the upstream portion. The developer is circulated in the developing device 4*d* in a substantially constant period as a whole, so that an accumulation value of the developer stirring time corresponds to the level of the toner spent and by extension to the charging performance of the carrier.

<Disposition of Carrier Supply Opening>

As shown in FIG. 2, the wall surface of the developing device 4*d* is provided with the discharge opening 40 for the developer, so that the developer containing the deteriorated carrier is discharged through the discharge opening 40 as indicated by an arrow Rh. When the carrier is supplied through the carrier supply opening 33*b*, the amount of the developer in the developing device 4*d* is increased to raise the developer surface, so that the developer is discharged so as to overflow from the discharge opening 40 correspondingly to the increased amount.

Also by the toner supply, the amount of the developer in the developing device 4*d* is increased to raise the developer surface, so that the developer in the amount corresponding to the supplied amount can be discharged through the discharge opening 40. Such a mechanism functions, so that the amount of the developer in the developing container 22 is kept substantially constant. Further, the developer discharged through the discharge opening 40 is fed to the longitudinal end portion of the developing device 4*d* by a collecting screw 41 disposed along an outer wall surface of the stirring chamber 24 and is then introduced downward, thus being collected in an unshown collected developer storing container.

As shown in FIG. 3, in Embodiment 1, the toner supply opening 33*a* is disposed at the upstream end portion of the stirring chamber 24, the discharge opening 40 is disposed at the longitudinal central portion of the stirring chamber 24, and the carrier supply opening 33*b* is disposed immediately downstream of the discharge opening 40. On the downstream side of the toner supply opening 33*a* and at the longitudinal central portion of the stirring chamber 24, the discharge opening 40 and the carrier supply opening 33*b* are disposed adjacently to each other. Incidentally, in this embodiment, the longitudinal central portion of the stirring chamber 24 refers to a central region when the stirring chamber 24 is divided into three equal regions with respect to the longitudinal direction.

In the case where an end portion A on the downstream side of the developing sleeve 28 with respect to the developer feeding direction is considered as a starting point, the toner supply opening 33*a* is located on the upstream side of the carrier supply opening 33*b* and the discharge opening 40. This is because a length of the path from the toner supply until the toner reaches the developing sleeve 28 is prolonged and thus the supplied toner is sufficiently stirred with the already-existing developer to uniformize the developer.

On the other hand, in the case where the length of the path from the toner supply opening 33*a* to the developing sleeve 28 is short, the toner is coated on the developing sleeve 28 before being triboelectrically charged sufficiently and therefore the developer density is increased. A degree of toner scattering from the developing sleeve 28 is increased. Particularly, in the case where the image formation with the high image ratio is continued and thus the toner is supplied in a large amount, the toner content of the developer becomes non-uniform and thus there is a possibility that density non-uniformity occurs in the output image.

Next, the discharge opening 40 is disposed at a downstream position spaced from the toner supply opening 33*a*. This is for the following reason. In the case where the discharge opening 40 is disposed on the upstream side of the stirring chamber 24, the toner supply opening 33*a* is inevitably disposed on the downstream side of the discharge opening 40. As a result, the length of the path from the toner supply opening 33*a* to the developing sleeve 28 is shortened and as described above, a possibility that the developer is fed to the developing sleeve 28 with non-uniform toner content (concentration).

Here, when the stirring chamber 24 is extended to the downstream side, the path length from the toner supply opening 33*a* to the developing sleeve 28 can be ensured on the downstream side of the discharge opening 40 but there is a disadvantage that the developing device 4*d* is increased in size.

Further, it would be considered that a constitution in which the toner supply opening 33*a* and the discharge opening 40 are disposed adjacently to each other at the same longitudinal position of the stirring chamber 24 is employed but this constitution is not preferable since there is a possibility that the toner supplied from the toner supply opening 33*a* is discharged as it is from the discharge opening 40. Further, to the extent that the supplied toner is not discharged as it is, the discharge opening 40 may preferably be disposed with a certain degree of a distance from the toner supply opening 33*a*.

Next, the carrier supply opening 33*b* is disposed close to and at the downstream position of the discharge opening 40. This is for the following reason. In order to maintain the performance of the developer by supplying a fresh carrier to the developing device 4*d*, it is preferable that the fresh carrier which has just been supplied is not discharged through the discharge opening 40.

The reason why the developer is discharged from the discharge opening 40 is that the amount of the developer in the developing device 4*d* is increased by the supply of the developer to raise the developer surface and thus the developer runs over the discharge opening 40 to cause overflow. When the process in which the developer surface is raised is observed specifically, immediately after the carrier is supplied, the developer surface is locally raised only at a supplied portion and then is gradually raised as a whole with diffusion of the fresh carrier by the feeding of the developer through the feeding screw 26.

When the developer is intended to be discharged so as not to completely contain the fresh carrier, there is a need to create a state of the discharge opening 40 such that the developer surface is raised without containing the fresh carrier but this is impossible. Therefore, in order to maintain the charging performance of the carrier to the utmost by preventing immediate discharge of the supplied carrier to the utmost, the fresh carrier is required to be sufficiently stirred and diffused into the already-existing developer by the feeding screw 26.

For that purpose, it is preferable that on the circulation path of the developer, the carrier supply opening 33*b* is disposed on the downstream side of the discharge opening 40 and the discharge opening 40 is disposed at a position in which the discharge opening 40 is remotest from the carrier supply opening 33*b* in the developer feeding direction.

Further, when the supplied carrier is fed to the developing sleeve 28 in a state in which the carrier is not sufficiently dispersed in the developer, distribution non-uniformity of the toner on the developing sleeve 28 is caused and leads to image density non-uniformity. For this reason, there is a need to ensure also the length of the path from the carrier supply opening 33*b* to the developing sleeve 28 so that the carrier can be sufficiently stirred and mixed until the carrier reaches the developing sleeve 28.

However, the carrier has a specific gravity close to that of the developer and therefore compared with the toner, the carrier is liable to be mixed with the developer, so that the carrier supply opening 33*b* can be disposed closer to the developing sleeve 28 than the toner supply opening 33*a*.

As described above, the carrier supply opening 33*b* may preferably be disposed close to and on the downstream side of the discharge opening 40 with respect to the developer feeding direction.

Comparative Embodiment

Figure 7:
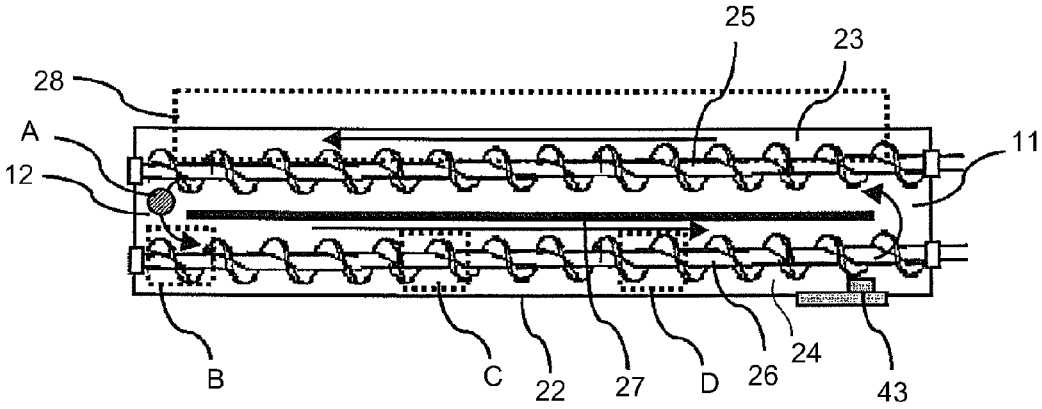
FIG. 7 is an illustration of a developing device in Comparative Embodiments.

FIG. 7 is an illustration of a developing device in Comparative Embodiments. In the developing device shown in FIGS. 2 and 3, a positional relationship among the toner supply opening 33*a*, the carrier supply opening 33*b* and the discharge opening 40 was changed to evaluate the developer charging performance and image density uniformity in continuous image formation.

As shown in FIG. 7, at positions B, C and D, the toner supply opening 33*a*, the carrier supply opening 33*b* and the discharge opening 40 shown in FIG. 3 were disposed in different disposition patterns in Comparative Embodiments 2 to 6 and the evaluation was made with respect to the dispositions in Embodiment 1 and Comparative Embodiments 2 to 6.

The continuous image formation was effected by conducting a durability test in which a monochromatic image with the image ratio of 10% was successively formed on 100,000 sheets by the image forming apparatus 100 (FIG. 1). Every 5,000 sheets, the developer charging performance and the image density uniformity were evaluated. The results are shown in Table 1.

TABLE 1

| EMB. NO. | | B | C | D | CAS*1 | DU*2 |
|---|---|---|---|---|---|---|
| EMB. 1 | | TSO*3 | DDO*4 | CSO*5 | ○ | ○ |
| COMP. EMB. | 2 | TSO | CSO | DDO | X | ○ |
| | 3 | CSO | TSO | DDO | X | X |
| | 4 | CSO | DDO | TSO | X | X |
| | 5 | DDO | CSO | TSO | ○ | X |
| | 6 | DDO | TSO | CSO | X | X |

*1"CAS" represents charge amount stability.
*2"DU" represents (image) density uniformity.
*3"TSO" represents the toner supply opening 33a.
*4"DDO" represents the developer discharge opening 40.
*5"CSO" represents the carrier supply opening 33b.

As shown in Table 1, in the developing device 4*d* in Embodiment 1, compared with those in Comparative Embodiments 2 to 6, a degree of the lowering in developer charge amount is small and the image density non-uniformity due to the distribution non-uniformity of the toner in the developer is also less liable to occur. In Table 1, compared with Embodiment 1, a large change in developer charge amount was evaluated as "x", and an occurrence of the image density non-uniformity was evaluated as "x". The developer charge amount was measured in the following manner. After 2 g of the toner and 2 g of the carrier were supplied and the developing sleeve 28 is idled for a certain time, the developer on the developing sleeve 28 was collected and a distribution of the toner charge amount Q/M was measured and compared. The toner supply amount for one time was normally suppressed to 1 g or less at the maximum but in this experiment the supply amount was set at 2 g in order to clarify a difference.

As a result, in either of Comparative Embodiments 2 to 6, the stability of the toner charge amount and the uniformity of the image density could not be realized in combination.

In Comparative Embodiment 2 in which the discharge opening 40 is disposed at the position D of the stirring chamber 24 and the carrier supply opening 33*b* is disposed at the position C on the upstream side of the position D, the supplied carrier is immediately discharged through the discharge opening 40. For this reason, the charging performance of the carrier is less liable to be restored and is lowered in toner charge amount Q/M compared with that in Embodiment 1.

In Comparative Embodiments 3 and 4 in which the toner supply opening 33*a* is disposed at the positions C and D, respectively, of the stirring chamber 24, the path length from the toner supply opening 33*a* to the developing sleeve 28 is short and therefore the toner charge amount Q/M is lowered, so that the image density non-uniformity occurs.

In Comparative Embodiment 5 in which the toner supply opening 33*a* is disposed at the position D of the stirring chamber 24, non-uniformity of charge impartment to the supplied toner occurred and the density uniformity was impaired. In Comparative Embodiment 6 in which the toner supply opening 33*a* is disposed at the position C of the stirring chamber 24, the image density non-uniformity and the lowering in charge amount occurred.

Therefore, according to the constitution of Embodiment 1, in the constitution in which the toner and the carrier are independently supplied and the developer is discharged from the discharge opening, efficiency enhancement of a degree of recovery of the developer charging performance by the supply of the carrier is achieved. At the same time, the density non-uniformity due to the non-uniformity of the toner:carrier ratio by the carrier supply can be obviated.

Embodiment 2

Figure 8:
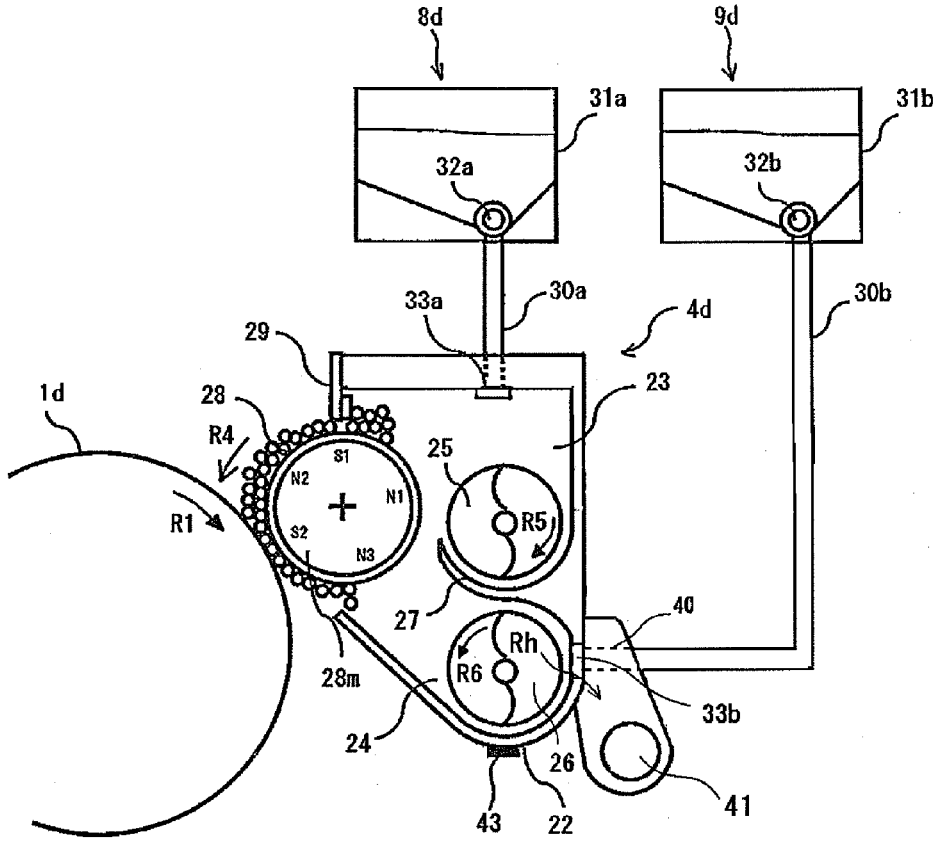
FIG. 8 is an illustration of a developing device in Embodiment 2.
Figure 9:
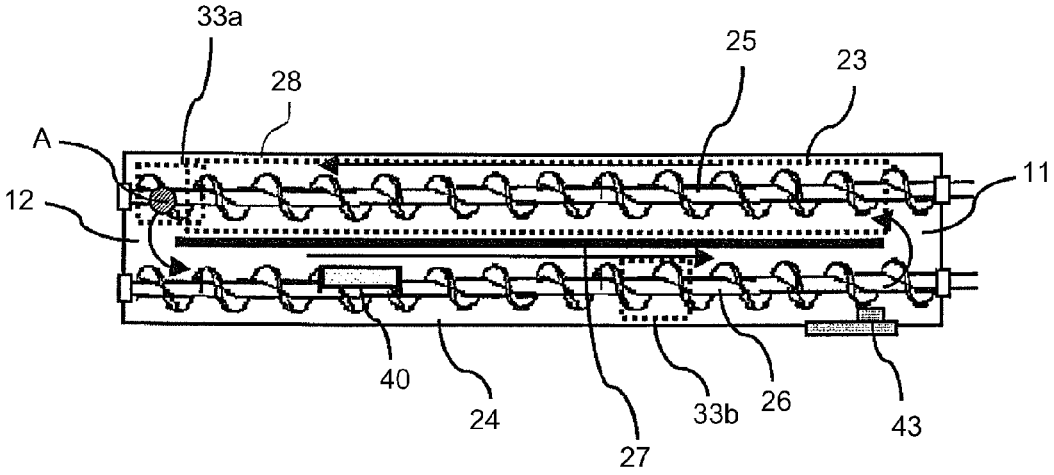
FIG. 9 is a sectional view of the developing device in Embodiment 2 as seen from a side surface.

FIG. 8 is an illustration of a structure of a developing device in Embodiment 2. FIG. 9 is a sectional view of the developing device in Embodiment 2 as seen from a side surface.

In Embodiment 2, the present invention is applied to a vertical type developing device in which the developing chamber 23 and the stirring chamber 24 are vertically disposed. The developing device in Embodiment 2 is provided in the image forming apparatus 100 by replacing the developing device 4*d* shown in FIG. 1 therewith. In this embodiment, in order to facilitate comparison with Embodiment 1, in FIGS. 8 and 9, members corresponding to those for the developing device 4*d* in Embodiment 1 are represented by the common reference numerals or symbols and will be omitted from redundant description.

As shown in FIG. 8, with respect to the vertical type developing device 4*d*, the developer (two-component developer) containing the toner and the carrier is accommodated in the developing container 22. In the developing container 22, the developing sleeve 28 as the developer carrying member and the regulating blade (chain cutting member) 29 for regulating the chain of the developer carried on the developing sleeve 28 are provided.

An inner portion of the developing container 22 is vertically partitioned into the developing chamber 23 and the stirring chamber 24 at a substantially vertical central portion by a partition wall 27 extending in a direction perpendicular to the drawing sheet. The developer is accommodated in the developing chamber 23 and the stirring chamber 24.

In the developing chamber 23 and the stirring chamber 24, feeding screws 25 and 26 as first and second feeding members, respectively, for stirring and feeding the developer are disposed. The feeding screw 25 is disposed in substantially parallel to the developing sleeve 28 and is rotated in the direction (clockwise direction) indicated by the arrow R5, so that the developer in the developing chamber 23 is fed in one direction of the axial direction. This is because the rotation in the clockwise direction is advantageous from the viewpoint of the feeding of the developer to the developing sleeve 28.

Further, the feeding screw 26 is disposed in the stirring chamber 24 in substantially parallel to the feeding screw 25 and is rotated in the direction (counterclockwise direction) indicated by the arrow R6 opposite to the rotational direction of the feeding screw 25 to feed the developer in the stirring chamber 24 in the opposite direction to that of the feeding screw 25.

As shown in FIG. 9, the developer fed by the feeding screws 25 and 26 is transferred through the openings 11 and 12 at both end portions of the partition wall 27, thus being circulated between the developing chamber 23 and the stirring chamber 24.

As shown in FIG. 2, an opening of the developing container 22 is provided at a position corresponding to a developing region in which the developing sleeve 28 opposes the photosensitive drum 1*d*, and the developing sleeve 28 is disposed rotatably at the opening so as to be partly exposed toward the photosensitive drum 1*d*.

Inside the developing sleeve 28, a magnet roller 28*m* which is a magnetic field-generating member for confining the carrier is disposed in a non-rotatable state. The magnet roller 28*m* has a developing pole (magnetic pole) S2 disposed to oppose the photosensitive drum 1*d*, a magnetic pole S1 disposed to oppose the regulating blade (chain-cutting member) 29, a magnetic pole N2 disposed between the magnetic poles S1 and S2, a magnetic pole N1 disposed to oppose the developing chamber 23, and a magnetic, pole N3 disposed to opposes the stirring chamber 24.

The developing sleeve 28 is rotated: in the direction (counterclockwise direction) indicated by the arrow R4 during the development and is supplied with the developer from the feeding screw 25 rotating in the developing chamber 23. The developing sleeve 28 carries the developer which has been subjected to the layer thickness regulation by the regulating blade 29 in the magnetic brush state, and feeds the developer to the developing region in which the developing sleeve 28 opposes the photosensitive drum 1*d*. Then, the electrostatic image formed on the photosensitive drum 1*d* is supplied with the developer and is reversely developed into the toner image. The developer remaining on the developing sleeve 28 is separated from the developing sleeve 28 by a repelling electric field between the magnetic poles N1 and N3 of the magnet roller 28 and flows into the stirring chamber 24, thus being fed by the feeding screw 26.

The developing bias, the developing blade 29, the developer, the settings such as the voltage values, and the operating condition are similar to those in Embodiment 1.

As shown in FIG. 9, in Embodiment 2, the toner supply opening 33*a* was disposed at the lowermost-stream position of the developing chamber 23, and the discharge opening 40 was disposed on the upstream side of the longitudinal central portion of the stirring chamber 24. When the downstream side end portion A of the developing sleeve 28 is taken as the start point, from the upstream side with respect to the developer feeding direction, the toner supply opening 33*a*, the discharge opening 40 and the carrier supply opening 33*b* are disposed in this order.

With respect to the developing device 4*d* having the above constitution, when those in Comparative Embodiments 2 to 6 were prepared and compared similarly as in Embodiment 1, only the disposition constitution in Embodiment 2 did not cause the lowering in developer charge amount and the image density non-uniformity.

(1) Comparative Embodiment 2

The toner supply opening 33*a*, the carrier supply opening 33*b* and the discharge opening 40 were disposed in this order from the upstream side with respect to the developer feeding direction. The supplied carrier is immediately discharged through the discharge opening 40.

(2) Comparative Embodiment 3

The carrier supply opening 33*b*, the toner supply opening 33*a* and the discharge opening 40 were disposed in this order from the upstream side with respect to the developer feeding direction. The path length from the toner supply opening 33*a* to the developing sleeve 28 is short and therefore the toner charge amount is lowered and the image density non-uniformity occurs.

(3) Comparative Embodiment 4

The carrier supply opening 33*b*, the discharge opening 40 and the toner supply opening 33*a* were disposed in this order from the upstream side with respect to the developer feeding direction. The path length from the toner supply opening 33*a* to the developing sleeve 28 is short and therefore the toner charge amount is lowered and the image density non-uniformity occurs.

(4) Comparative Embodiment 5

The discharge opening 40, the carrier supply opening 33*b* and the toner supply opening 33*a* were disposed in this order from the upstream side with respect to the developer feeding direction. The path length from the toner supply opening 33*a* to the developing sleeve 28 is short and therefore the toner charge amount is lowered and the image density non-uniformity occurs.

(5) Comparative Embodiment 6

The discharge opening 40, the toner supply opening 33*a* and the carrier supply opening 33*b* were disposed in this order from the upstream side with respect to the developer feeding direction. The path length from the toner supply opening 33*a* to the developing sleeve 28 is insufficient and therefore the image density non-uniformity and the lower in charge amount occur.

Therefore, according to the constitution of Embodiment 1, in the constitution in which the toner and the carrier are independently supplied and the developer is discharged from the discharge opening, a degree of recovery of the developer charging performance by the supply of the carrier is enhanced efficiently. At the same time, the density non-uniformity due to the non-uniformity of the toner:carrier ratio by the carrier supply can be obviated.

In the image forming apparatus of the present invention, the second developer is supplied on the downstream side of the discharge opening with respect to the developer feeding direction and therefore the carrier which has just been supplied is not discharged from the discharge opening. The first developer supplied on the upstream side of the discharge opening is sufficiently mixed and stirred with the already-exiting developer in the process in which the first developer is fed in the first feeding path, thus being carried on the developer carrying member in the state in which the first developer stably occupies a certain proportion of the developer. The carrier supply amount is not so fluctuated compared with the toner supply amount and due to the size and the number of particles, an opportunity of friction of one carrier particle is more than that of one toner particle. For this reason, even when a stirring length of the second developer is not so long comparably to that of the first developer, the second developer is triboelectrically charged until the second developer reaches the developer carrying member.

Therefore, it is possible to ensure sufficient mixing and stirring and to ensure triboelectric charging until a developer reaches a developer carrying member, even when toner and a carrier are supplied to a circulation path of the developer, without adding a dedicated feeding path. As a result, the carrier which is only just supplied and is not deteriorated is less liable to be discharged from a discharge opening, and a charging performance of the developer is stable and reproducibility of an image density is high. Further, the developing device is also suitable for resource saving and electric power saving.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 026864/2010 filed Feb. 9, 2010, which is hereby incorporated by reference.

What is claimed is:

1. A developing device comprising:

a developer carrying member;

a first feeding path in which a developer is to be supplied and fed to said developer carrying member at a position in which said first feeding path opposes said developer carrying member;

a second feeding path, communicating with said first feeding path, for forming a circulation path with said first feeding path;

a discharge opening for permitting discharge of an excessive developer in said developing device;

a first supply opening, located downstream of said first feeding path opposing said developer carrying member with respect to a developer feeding direction and located upstream of said discharge opening with respect to the developer feeding direction, for permitting supply of a first developer containing at least toner; and a second supply opening, located upstream of said first feeding path with respect to the developer feeding direction and located downstream of said discharge opening with respect to the developer feeding direction, for permitting supply of a second developer which has a toner ratio lower than a toner ratio of the first developer or is consisting only of a carrier.

2. A device according to claim 1, wherein a distance from a supply position of the first developer to said discharge opening along the developer feeding path is longer than a distance from said discharge opening to a supply position of the second developer.

3. A device according to claim 1, wherein a distance from a supply position of the second developer to said developer carrying member along the developer feeding path is longer than a distance from said discharge opening to the supply position of the second developer.

4. A device according to claim 1, wherein a supply position of the first developer is disposed at an upstream side end portion of said second heeding path, and wherein said discharge opening and a supply position of the second developer are disposed at a central portion of said second feeding path.

5. A device according to claim 1, wherein the first developer has a toner ratio of 100%.

* * * * *